United States Patent [19]

Liebscher et al.

[11] 4,094,032

[45] June 13, 1978

[54] CLEANING DEVICE

[75] Inventors: Johannes Liebscher, Nassau (Lahn); Rolf G. Schülein, Singhofen; Waldemar Fobbe, Nassau (Lahn), all of Germany

[73] Assignee: Leifheit International Gunter Leifheit GmbH, Nassau (Lahn), Germany

[21] Appl. No.: 650,942

[22] Filed: Jan. 21, 1976

[30] Foreign Application Priority Data

Jan. 24, 1975 Germany ..... 2502763

[51] Int. Cl.[2] ..... A47L 11/33

[52] U.S. Cl. ..... 15/41 R; 15/179

[58] Field of Search ..... 15/41 R, 48, 79 R, 179, 15/182, 383, 389, 388

[56] References Cited

U.S. PATENT DOCUMENTS

| | | | |
|---|---|---|---|
| 683,413 | 9/1901 | Reynolds | 15/79 |
| 1,073,301 | 9/1913 | Spangler | 15/388 |
| 1,151,731 | 8/1915 | Spangler | 15/388 X |
| 1,350,664 | 8/1920 | Merriman | 15/41 X |
| 2,054,194 | 9/1936 | Fineberg | 15/41 R |
| 2,226,581 | 12/1940 | Richardson | 15/41 R |
| 2,536,443 | 1/1951 | Hammell | 15/388 X |
| 3,145,405 | 8/1964 | Himes et al. | 15/41 R |

FOREIGN PATENT DOCUMENTS

| | | | |
|---|---|---|---|
| 464,048 | 4/1937 | United Kingdom | 15/388 |

*Primary Examiner*—Edward L. Roberts
*Attorney, Agent, or Firm*—Michael J. Striker

[57] ABSTRACT

A cleaning device includes a cylindrical brush which is mounted in a housing for rotation about an axis transverse to the direction of movement of the cleaning device over the surface to be cleaned. The brush has at least two sections which are independently driven into rotation about their axis by wheels which are also mounted in the housing. Motion is transmitted between the wheels and the two sections of the brush so that, when wheels on one side of the housing rotate at a different speed than the wheels on the other side of the housing, the rotations of the two sections of the brush about the axis are also different. A connecting element connects the two end portions of the sections of the brush which are adjacent to one another. Such connecting element may be connected to one of the sections of the brush for shared rotation therewith, or may connect the respective end portions with freedom of rotation relative thereto. An arrangement for adjusting the distance of the brush from the surface to be cleaned may be provided. The dirt picked up from the surface by the brush is deposited into a pair of receptacles arranged alongside the brush.

14 Claims, 6 Drawing Figures

CLEANING DEVICE

BACKGROUND OF THE INVENTION

The present invention relates to a cleaning device in general, and more particularly to a device for cleaning a surface, which is equipped with a brush which picks up dirt from the surface to be cleaned and deposits it into a dirt-collecting receptacle.

There are already known various cleaning devices of the type here under consideration. Usually, they include a housing in which wheels are mounted for rotation, such wheels engaging the surface to be cleaned, during the use of the cleaning device for cleaning the surface. At least one cylindrical brush is mounted in the housing for rotation about its longitudinal axis, the brush extending transverse of the direction of movement of the device over the surfface and being parallel to the latter. The aforementioned wheels, or at least some of them, drive the cylindrical brush into rotation about the longitudinal axis thereof so that the bristles of the brush, which contact the surface to be cleaned, pick up dirt therefrom and deposit the same into receptacles which are mounted in the housing alongside the cylindrical brush. The housing of the cleaning device is usually equipped with a handle adapted to be grasped by the user of the device so that the movement of the handle results in a corresponding movement of the device over the surface to be cleaned.

A cleaning device of this type is already known in which the wheels are mounted in the lateral portions of the housing when considered in direction of movement of the device over the surface to be cleaned, and the rotation of the wheels is converted into the rotation of the cylindrical brush in that frictional or gear-type engagement is accomplished between the wheels mounted at the opposite lateral sides of the housing and the longitudinally opposite end portions of the cylindrical brush. This arrangement is completely satisfactory so long as the cleaning device is to be moved over the surface only in a straight path or in straight path portions. Under such circumstances, the angular speeds of rotation of the wheels arranged at the opposite sides of the housing are the same so that the cylindrical brush will be driven into rotation at the same speed by the wheels at one lateral side of the housing as by the wheels arranged at the other lateral side of the housing. However, the situation is quite different when it is desired to move the cleaning device over the surface to be cleaned along a curved path, a situation which is unavoidable when the cleaning device is to be used for removing dirt from corner regions of the surface. So, for instance, when such a cleaning device is to be used for cleaning floors, movement thereof along a curved path is necessary for removing dirt from regions along the baseboards, and particularly in the corner regions of the room and along the bases of furniture pieces standing on the floor. It will be appreciated, however, that when the cleaning device is used for a different purpose, that is, for cleaning surfaces other than floors, similar problems will also be encountered.

The difficulties encountered in these conventional cleaning devices in which the cylindrical brush is driven into rotation at both ends thereof from wheels mounted in lateral portions of the housing, are attributable to the fact that when the cleaning device moves along an arcuate path, the driving wheel which is closer to the instantaneous pole of the curved path than the other wheel rotates at a lesser speed than the wheel which is more spaced from the instantaneous pole. The difference between the speeds of rotation of the wheels mounted at the opposite lateral sides of the housing will be proportionate to the instantaneous radius of curvature of the curved path.

In view of the fact that the wheels mounted at opposite lateral sides of the housing are in driving engagement with the one-piece cylindrical brush, the wheels at one side of the housing will attempt to drive the brush at a higher speed than the wheels at the other side. Therefore, not only will the differential speeds of the wheels to the two sides of the housing result in subjection of the brush to additional torsional stresses but, in the final analysis, the slower-moving wheels will retard the rotation of the faster moving wheels, there will be slippage between the wheels and the surface to be cleaned, and the overall cleaning effectiveness of the cleaning device will be diminished during the movement thereof in a curved path. An additional disadvantage is to be seen in the fact that, when it is desired to move the cleaning device in a curved path, a much higher force must be applied to the device in order to move it over the surface to be cleaned than for moving the device in a straight path, this being attributable to the need for overcoming the frictional engagement of the wheels with the surface to be cleaned in order to achieve the necessary slippage.

This problem has already been recognized, and it has been proposed to overcome this disadvantage by providing a brush in which the shaft of the brush is constituted by coaxial sections, so that the sections of the brush can rotate at different speeds during the movement of the device in a curved path. However, in all of the heretofore known cleaning devices of this type, the construction of the shaft of the cylindrical brush of several sections resulted in reduction in the cleaning effectiveness of the cleaning device, and in a substantial increase in the force which is needed for moving the cleaning device over the surface to be cleaned, at least during the movement of the cleaning device along a curved path.

SUMMARY OF THE INVENTION

Accordingly, it is a general object of the present invention to avoid the disadvantages of the prior art.

More particularly, it is an object of the present invention to provide a cleaning device which may be as easily moved in a straight path as in a curved path.

It is still another object of the present invention to provide a cleaning device which is simple in construction and reliable in operation.

A concomitant object of the present invention is to provide a cleaning device which requires only a minimum amount of force for moving the same over the surface to be cleaned, whether in a straight or in a curved path.

Yet another object of the present invention is to provide a cleaning device which is equally effective for cleaning purposes whether moving in a straight or a curved path over the surface to be cleaned.

In pursuance of these objects and others which will become apparent hereafter, one feature of the present invention resides, briefly stated, in a device for cleaning a surface, in a combination which comprises a housing; a plurality of wheels mounted in the housing for rotation in engagement with the surface to be cleaned; and an elongated cleaning body which includes at least two separate cleaning sections which are mounted in the housing for rotation about a longitudinal axis of the cleaning body and each of which has a cleaning portion which contacts the surface to be cleaned to clean the same, the cleaning sections being axially adjacent one another. A motion-transmitting means is interposed between at least one of the wheels and one of the cleaning sections and at least another wheel and another cleaning section, and is operative for individually rotating the cleaning sections about the longitudinal axis in response to rotation of the one and the other wheel, respectively.

According to a currently preferred embodiment of the present invention, the cleaning sections have separate shafts which are coaxial with one another, and each of the shafts is provided with frictional or gear wheels which cooperate with the corresponding portions of the respective wheels. The shafts of the cleaning sections are connected by means of a connecting element which may be mounted in one of the shafts for rotation therewith, and freely supported at the other shaft, or which may be freely supported at both shafts.

The shafts of the cleaning sections are rigidly connected with the cleaning portions which, according to a currently preferred embodiment of the present invention, include bristles adapted to contact the surface to be cleaned and pick up dirt therefrom in order to deposit it into a dirt-collecting receptacle.

As a result of this construction, the wheel or wheels at one of the lateral sides drive the associated cleaning section at a speed which is different from the speed of rotation of the other shaft driven by the wheels arranged at the other side of the housing when the cleaning device moves along a curved path. Thus, the slower rotation of the wheels which are closer to the instantaneous pole of the curved path does not retard the higher speed of rotation of the wheels which are more distant from the instantaneous pole during movement of the cleaning device in a curved path. This is so because of the fact that the two cleaning sections can rotate at different speeds about the longitudinal axis of the brush under such circumstances. On the other hand, when the cleaning device moves over the surface to be cleaned in a straight path, that is, when the speeds of rotation of the driving wheel of the cleaning device are the same for both sides of the housings, the cleaning sections move at the same angular speeds. Thus, under these circumstances, the brush is as effective for picking up dirt from the surface to be cleaned as if it were made of one piece.

The inventive concept of the present invention can be utilized in several differently constructed embodiments. So, for instance, the two cleaning sections which are to form the cleaning body with one another are of the same configuration, which facilitates the manufacture thereof and renders it possible to freely interchange such cleaning sections during the assembly of the device or subsequent repair.

According to a currently preferred aspect of this embodiment, the end portions of the cleaning sections, or of the shafts thereof, which are to face one another in the assembled condition of the cleaning device, are provided with bearing recesses in which the connecting element is accommodated.

The connecting element may be configurated as a substantially cylindrical pin having two end portions both of which can be freely received in the bearing recesses of the two cleaning sections or shafts, or one of which can be so received in the associated recess as to positively share the rotation of the associated shaft or cleaning section, while the other end portion of the connecting element is received in the recess of the other shaft or cleaning portion with freedom of rotation relative thereto.

Instead of providing a cylindrical connecting element, a connecting element may be provided which includes a disc-shaped portion which is received between the two shafts or cleaning sections in the assembled condition of the cleaning body, and coaxial projections or pins can extend from the disc-shaped portion and be received in the respective recesses provided in the associated cleaning portions or shafts. The connecting element may be of metallic or synthetic plastic material.

On the other hand, the two cleaning sections or the shafts thereof may be configurated differently from one another, one of the cleaning sections or shafts having a male projection, and the other shaft or cleaning section having a female recess adapted to coaxially receive the male projection of the first-mentioned shaft or cleaning section. It is currently preferred to so configurate the cooperating male and female connecting portions that the female portion engages behind the male portion with snap action so as to prevent axial movement of the shafts or cleaning sections away from one another.

It is also proposed according to the present invention to configurate the connecting element as a sleeve, that is, to give the connecting element a tubular configuration, in which case the end portions of the shafts of the cleaning sections are received in the tubular connecting element. Here again, it may be advantageous to positively connect the connecting element with one of the shafts for shared rotation therewith, whereas the other shaft is received in the connecting element with freedom of rotation relative thereto. It is particularly advantageous in this embodiment of the present invention to provide additional cleaning portions, such as bristles, on the connecting element so that the cleaning body is capable of cleaning a surface even in the region of the connecting element.

When the sectional cleaning body of the present invention is to be used in a cleaning device in which the spacing of the axis of rotation of the cleaning body from the surface to be cleaned can be adjusted, it is proposed by the present invention to mount the shafts of the cleaning sections, or the cleaning sections themselves, in a support which is mounted in the housing of the cleaning device for displacement toward and away from the surface to be cleaned. Under such circumstances, a lever accessible from the exterior of the housing may be provided, and the support may be either directly connected to such lever, or connected thereto indirectly via a connecting link. In this situation, it is advantageous to mount the connecting element in a bracket which is provided in the support intermediate the ends of the support. It is also conceivable in this embodiment, to rigidly connect the connecting element to the bracket.

When dictated by the intended use of the cleaning device, or when otherwise made possible by the construction of the cleaning device, the cleaning sections could be provided with a frictional or gear drive at both ends thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
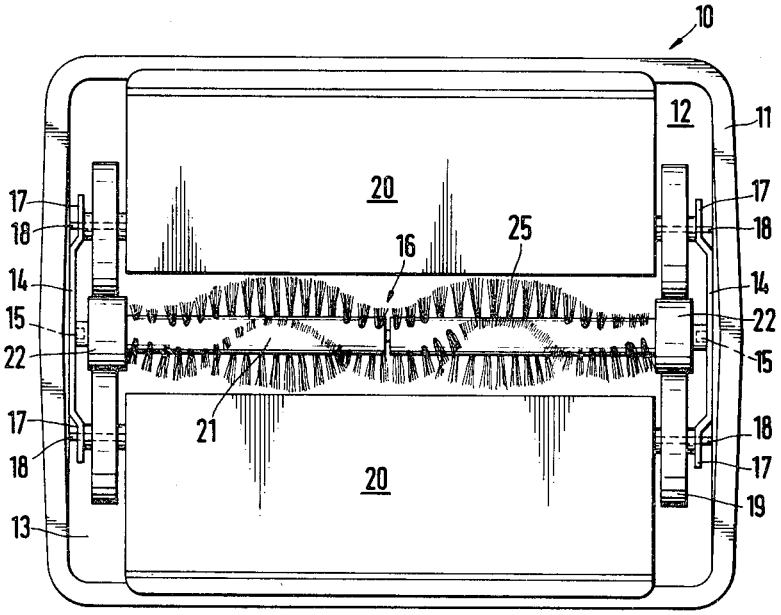
FIG. 1 is a bottom plan view of a cleaning device according to the present invention.

Referring now to the drawings, and first to FIG. 1 thereof, it may be seen that the reference numeral 10 indicates a cleaning device in toto, which cleaning device 10 is illustrated as a floor-cleaning device. However, it is to be understood that such device can also be used for different purposes than those explicitly referred to in the specification. All parts of the cleaning device 10 which are not illustrated or discussed in detail are conventional, and may be configurated differently from the illustrated embodiment. The housing 10 may be provided with a conventional handle which has not been illustrated, such handle serving the purpose of moving the housing over the surface to be cleaned.

The housing of the illustrated cleaning device 10 includes a frame 11, which may be of one piece and may consist of synthetic plastic material. The frame 11 constitutes the front, the rear and the lateral walls of the housing, and an upper portion 12 can be connected to the frame 11. The upper portion 12 may be of a rather rigid material, such as of sheet metal. It is to be understood, however, that the box-shaped housing 13 of the cleaning device 10 can be of one piece, such as of sheet metal and can be provided with a shock-absorbing portion of an elastic material, such as of rubber, at the lower edge thereof.

Bearing members 14, which may be of metal and which may have a T-shaped configuration, are connected to two opposite lateral sides of the housing 13 of the cleaning device 10, the bearing members 14 being provided with conventional, depressable bearing pins 15 in the central regions thereof, which bearing pins 15 project into the ends of the shaft 16 of the cylindrical brush. The bearing members 14 are further provided with slots for receiving axes 18 of driving wheels 19, the slots being provided in elastic arms 17 of the bearing members 14. The ends of the axes 18 are introduced into the respective slots in such a manner that the arms 17 are deflected in lateral direction of the housing 13, upon which the wheels 19 are received between the deflected arms 17 and the remainder of the housing, upon which the arms 17 are released so that they elastically resume their previous position so that the axes 18 are received in the corresponding slots of the arms 17 and prevented from disengaging therefrom. Each of the axes 18 is also used for pivotably mounting a dirt-collecting receptable 20 thereon. As clearly seen in FIG. 1, two such dirt-collecting receptacles 20 are arranged alongside the shaft 16 of the cylindrical cleaning body, to the two sides thereof.

While the arrangement of the present invention is also capable of being used in cleaning devices of other types, it has been illustrated and will now be discussed in connection with the illustrated cleaning device 10 which employs a cylindrical brush 21.

Figure 2:
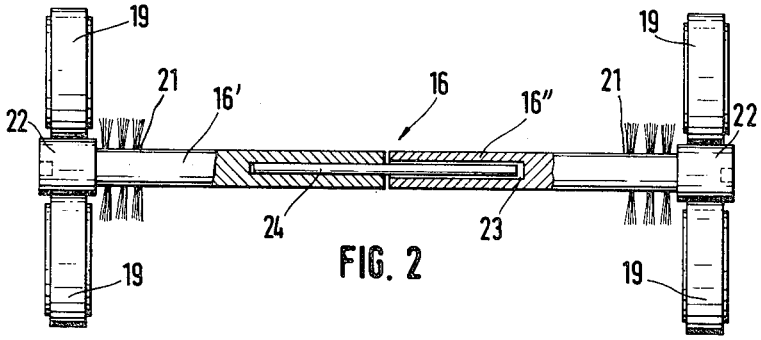
FIG. 2 is a partially sectioned view of a cylindrical brush and associated driving wheels illustrated in FIG. 1.

Referring now to FIG. 2, it may be seen therein that the cylindrical brush 21 of the cleaning device 10 is provided with frictional wheels 22 which are arranged at the ends of the shaft 16 of the cylindrical brush 21 and which are in frictional contact with the driving wheels 19 so that the latter drive the shaft 16 into rotation. However, it is also possible to provide intermeshing gear wheels at the respective driving wheels 19 and on the shaft 16, so as to obtain positive transmission of motion from the driving wheels 19 to the shaft 16. It will be appreciated that the shaft 16 of the cylindrical brush 21 rotates in an opposite direction than the driving wheels 19. As clearly illustrated in FIG. 2, the shaft 16 of the cylindrical brush 21 is constituted by two sections 16' and 16''. Each of these two shaft sections 16' and 16'' has its own frictional wheel 22 which cooperates with the driving wheels 19 arranged at one or the other lateral side of the housing 13 of the cleaning device 10, respectively.

The end portions of the shaft sections 16' and 16'', which are of identical configurations, are formed with bearing recesses 23, and a connecting element 24, which is configurated as a connecting pin, is received within the bearing recesses 23. The end of the connecting element 24 which cooperates with the shaft section 16' is received in the associated bearing recess 23 with pressure fit so as to share the rotation of the shaft section 16'. On the other hand, the bearing recess 23 provided in the shaft section 16'' receives the other end of the connecting element 24 with freedom of relative rotation. This configuration enables the shaft sections 16' and 16'' to perform differential angular movements about the axis of the cylindrical brush 16, particularly rotations at different angular speeds. However, it is also possible to freely accommodate both ends of the connecting element 24 in the associated bearing recesses 23 of the shaft sections 16' and 16''. FIG. 2 also illustrates that the bristles 25 of the cylindrical brush 21 may be arranged in bunches and helically surround the shaft 16 or the shaft sections 16' and 16'' thereof.

Figure 3:
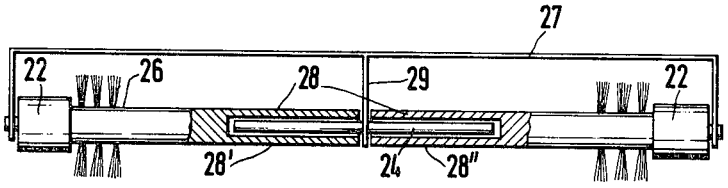
FIG. 3 is a partially sectioned view of a second embodiment of the brush of the present invention supported in a support.

A different embodiment of the cylindrical brush is illustrated in FIG. 3, such cylindrical brush being designated with the reference numeral 26. This cylindrical brush 26 is supported in a support which is capable of adjusting the distance of the axis of rotation of the cylindrical brush 26 from the surface to be cleaned. Such height-adjustment arrangement is also conventional so that only a U-shaped support member 27 thereof is illustrated. The support member 27 is acted upon, either directly, or via an interposed connecting link, with a non-illustrated actuating lever. Even this is entirely conventional. In this embodiment, a shaft 28 of the cylindrical brush 26 includes two shaft sections 28' and 28'', each of which carries its own frictional wheel 22 at its end, the frictional wheel 22 cooperating with the corresponding driving wheels 19. In this embodiment, the connecting element 24 is received in a bracket 29 which is arranged intermediate the lateral ends of the U-shaped support member 27. The connecting element 24 has projections which extend into the bearing recesses 23 which are provided in the mutually adjacent end portions of the shaft sections 28' and 28''. As clearly illustrated in FIG. 3, both of the shaft sections 28' and 28'' are supported on the connecting element 24 with freedom of rotation relative thereto.

Figure 4:
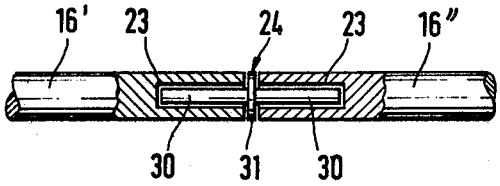
FIG. 4 is a partial view corresponding to FIG. 2 of a different embodiment of the present invention.

FIG. 4 illustrates an additional embodiment of the present invention for connecting the adjacent ends of the shaft sections 16' and 16''. Inasmuch as the overall construction of the cleaning device 10 in which this embodiment is used, except for the connection of the shaft sections 16' and 16'', is the same as discussed above in connection with FIGS. 1 and 2, the same reference numerals have been used to indicate the corresponding parts. The connecting element 24 is configurated as a coupling body which includes a disc-shaped central portion 31 from which pins 30 extend coaxially with the disc-shaped portion 31, the pins being received in the bearing recesses 23 of the shaft sections 16' and 16''. Also in this embodiment, the two shaft sections 16' and 16'' are supported on the projecting portions 30 with freedom of rotation thereabout. The disc-shaped central portion 31 prevents axial movement of the connection element 24 relative to the shaft sections 16' and 16''. The bristles 25 have been omitted in this Figure, but it is to be understood that they will be present and that they can be arranged and configurated similarly to those illustrated in FIGS. 1 and 2.

Figure 5:
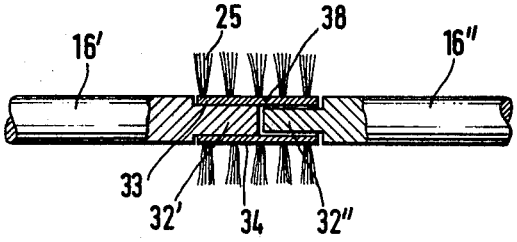
FIG. 5 is a view corresponding to FIG. 4 of a still different embodiment of the present invention.

FIG. 5 illustrates a further embodiment of the cylindrical brush 21 of the present invention which includes two shaft sections 16' and 16'' and which can be used in a cleaning device 10 illustrated in FIG. 1. Again, the same reference numerals have been used to designate similar parts. In this embodiment, the ends of the shaft sections 16' and 16'' are step-wise offset. The offset regions 32' and 32'' of the shafts 16' and 16'' are received in a tubular bearing sleeve 33. Preferably, the shaft section 16', as illustrated, is connected with the bearing sleeve 33 for shared rotation, and the offset portion 32'' of the shaft section 16'' is received in the bearing sleeve 33 with freedom of rotation relative thereto. In addition to being provided on the shaft sections 16' and 16'', the bristles 25 may also be provided at the outer surface 34 of the bearing sleeve 33.

Figure 6:
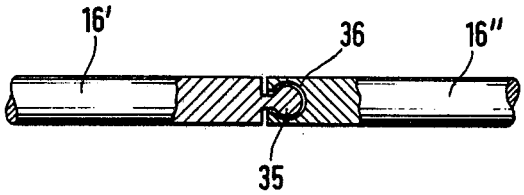
FIG. 6 is a view similar to FIG. 4 of another embodiment of the present invention.

As illustrated in FIG. 6, an end of the shaft section 16' may be provided with a male projection, such as a head 35, and the end portion of the other shaft section 16'' may be provided with a female recess adapted to receive the head 35, such recess being designated with the reference numeral 36. Preferably, the walls surrounding the recess 36 may be elastically yieldable so as to permit temporary spreading thereof during the insertion of the head 35 into the bearing recess 36. In this embodiment of the present invention, the shaft sections 16' and 16'' are to advantage made of synthetic plastic material.

As already mentioned before, the illustrated embodiments of the present invention are only exemplary, and the present invention is not to be deemed to be limited thereto. Rather, the illustrated embodiment may be modified in many respects, so long as the inventive idea thereof is adhered to. So, for instance, the wheels 19 could be mounted immediately at the ends of the shaft sections 16' and 16'' or 28' and 28''. Furthermore, intermeshing gears could be used instead of the illustrated frictional wheels. Finally, one of the frictional, gear or driving wheels could be arranged at each longitudinal end of the two shaft sections 16' and 16'' or 28' and 28''.

It will be understood that each of the elements described above, or two or more together, may also find a useful application in other types of constructions differing from the types described above.

While the invention has been illustrated and described as embodied in a cleaning device, it is not intended to be limited to the details shown, since various modifications and structural changes may be made without daparting in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a device for cleaning surfaces, a combination comprising a housing; an elongated cleaning body having a longitudinal axis and including at least two separate cleaning sections each having an elongated shaft and a cleaning portion surrounding said shaft, and means for coaxially connecting said shafts, including a coaxial spherical male end portion of one of said shafts and a coaxial female end portion of the other shaft which includes elastically yieldable wall means embracing said male portion for independent rotation, and engaging behind said male portion with a snap action to prevent axial displacement, of the connected shafts relative to one another; means for mounting said cleaning body in said housing for adjustment of the spacing of said longitudinal axis from a surface to be cleaned, including a generally U-shaped mounting element having two mounting portions extending transversely of, and an elongated connecting portion extending along, the mounted cleaning body and interconnecting said mounting portions, and a bracket affixed to said connecting portion intermediate said mounting portions, those end portions of said shafts that are remote from said male and female end portions being each mounted on one of said mounting portions of said mounting element, and at least one of said male and female end portions being supported on said bracket, for rotation relative thereto and for displacement therewith during the adjustment of said spacing; means for supporting said housing on the surface to be cleaned for movement relative thereto with said cleaning portions of said cleaning sections in contact therewith, including a plurality of wheels mounted on said housing for rotation in engagement with the surface being cleaned; and at least two motion-transmitting means each interposed between at least one of said wheels and one of said cleaning sections and operative for independently rotating the latter about said longitudinal axis in response to the rotation of said one wheel.

2. A combination as defined in claim 1; wherein said cleaning portion includes a plurality of bristles which extend substantially radially of said shaft.

3. A combination as defined in claim 2, and further comprising at least one receptacle mounted in said housing along said cleaning body and adapted to collect dirt picked up from the surface by said bristles.

4. A combination as defined in claim 3; and further comprising an additional receptacle similar to said receptacle and mounted in said housing at an opposite side of said cleaning body from said receptacle so that said bristles deposit dirt into said receptacle when said cleaning sections rotate in one direction about said longitudinal axis, and into said additional receptacle when said cleaning sections rotate in opposite direction.

5. A combination as defined in claim 1, wherein said shafts of said cleaning sections extend transversely of said housing when considered in direction of movement of the device over the surface to be cleaned; and wherein said wheels are mounted on lateral portions of said housing for rotation about axes parallel to said longitudinal axis of said cleaning body.

6. A combination as defined in claim 5, wherein said motion-transmitting means includes cylindrical portions on said shafts which are in frictional contact with said one wheel.

7. A combination as defined in claim 5, wherein said motion-transmitting means includes meshing gears on said shafts and said one wheel.

8. A combination as defined in claim 1, wherein said shaft is of metal.

9. A combination as defined in claim 1, wherein said shaft is of synthetic plastic material.

10. In a device for cleaning surfaces, a combination comprising a housing; an elongated cleaning body having a longitudinal axis and including at least two separate cleaning sections each having an elongated shaft and a cleaning portion surrounding said shaft, and means for coaxially connecting said shafts, including a coaxial male end portion of each of said shafts, and a discrete sleeve-shaped connecting element having a pair of coaxial female end portions each of which embraces one of said male portions for independent rotation of the connected shafts relative to one another; means for mounting said cleaning body in said housing for adjustment of the spacing of said longitudinal axis from a surface to be cleaned, including a generally U-shaped mounting element having two mounting portions extending transversely of, and an elongated connecting portion extending along, the mounted cleaning body and interconnecting said mounting portions, and a bracket affixed to said connecting portion intermediate said mounting portions, those end portions of said shafts that are remote from said male end portions being each rotatably mounted on one of said mounting portions of said mounting element, and said connecting element being supported on said bracket, for displacement therewith during the adjustment of said spacing; means for supporting said housing on the surface to be cleaned for movement relative thereto with said cleaning portions of said cleaning sections in contact therewith, including a plurality of wheels mounted on said housing for rotation in engagement with the surface being cleaned; and at least two motion-transmitting means each interposed between at least one of said wheels and one of said cleaning sections and operative for independently rotating the latter about said longitudinal axis in response to the rotation of said one wheel.

11. A combination as defined in claim 10, wherein said connecting element is connected with one of said shafts for shared rotation therewith.

12. A combination as defined in claim 10, wherein said shafts are of identical configuration.

13. A combination as defined in claim 10, wherein said connecting element is connected with one of said shafts for shared rotation therewith; and further including an additional cleaning portion surrounding said connecting element and in contact with the surface to be cleaned.

14. A combination as defined in claim 10, wherein said male end portions of said shafts have reduced diameters relative to the remainder of said shafts.

* * * * *